United States Patent [19]

Cianciotti

[11] 4,008,672

[45] Feb. 22, 1977

[54] WORK GUIDING AND TRIMMING APPARATUS FOR SEWING MACHINES

[75] Inventor: Nicholas Cianciotti, Punxsutawney, Pa.

[73] Assignee: Queen Casuals, Inc., Philadelphia, Pa.

[22] Filed: May 5, 1975

[21] Appl. No.: 574,434

[52] U.S. Cl. ..... 112/121.12; 112/121.15; 112/122; 112/148

[51] Int. Cl.[2] ..... D05B 21/00; D05C 9/04; D05B 37/00

[58] Field of Search ..... 112/121.15, 121.12, 112/122, 129, 130, 124, 123, 136, 148, 260

[56] References Cited

UNITED STATES PATENTS

| | | | |
|---|---|---|---|
| 1,197,112 | 9/1916 | Eberley | 112/121.12 |
| 2,355,023 | 8/1944 | Wiren | 112/121.12 |
| 2,617,374 | 11/1952 | deRobertis | 112/122 |
| 3,376,836 | 4/1968 | Nicolay | 112/124 |
| 3,696,765 | 10/1972 | Bernewasser | 112/121.12 |
| 3,749,038 | 7/1973 | Dodsworth | 112/136 X |

FOREIGN PATENTS OR APPLICATIONS

| | | | |
|---|---|---|---|
| 293,052 | 7/1965 | Netherlands | 112/121.15 |

*Primary Examiner*—Werner H. Schroeder
*Assistant Examiner*—Peter Nerbun
*Attorney, Agent, or Firm*—Robert C. Podwil

[57] ABSTRACT

An abutment associated with the bed of a sewing machine cooperates with a work holder to guide the work during a sewing operation, and a trimming blade operates in conjunction with the abutment to simultaneously trim the work adjacent to the zone in which stitches are made without interfering with the work holder or guidance of the work.

16 Claims, 7 Drawing Figures

WORK GUIDING AND TRIMMING APPARATUS FOR SEWING MACHINES

This invention relates to work guiding and trimming apparatus for sewing machines, and more particularly, to forms of such apparatus wherein sewing and trimming of work (or an assembly of work), is accomplished simultaneously, with the aid of a work holder and guide, and without interfering with the function of the work holder and guide.

In the manufacture of collars and other components of garments made up of plies of fabric, facings and the like, the various plies have sometimes heretofore been held together in stacked relationship in a work holder and guide comprising a pair of slotted flat sheets. The edges of the slot in the work holder provides a guide edge or template, engageable by a vertically extending projection associated with the presser foot or bed of a sewing machine. British Pat. No. 653,177, issued to Gardner, May 9, 1951, U.S. Pat. Nos. 3,172,379, to Light, issued Mar. 9, 1965; and 3,749,038, to Dodsworth issued July 31, 1973 illustrate such a concept. U.S. Pat. Nos. 1,623,075, to Thomas issued Apr. 5, 1927, and 3,557,727, to Heimann, issued Jan. 26, 1971, are also somewhat related to this general concept.

Using the construction of a collar as an example, application of the techniques disclosed in the above-mentioned patents involves the following steps: First, blanks for the outer plies of the collar and any interfacing material are cut, by hand or die cutting, to approximately their finished shape. After stacking (which could be done prior to or after the initial cutting step), the plies are positioned within the work holder. Positioning requires a degree of care to properly locate the desired stitch line with respect to the guide edge. Next, stitching is done, with the benefit of the guidance provided by the work holder, and the stitched assembly is then removed from the work holder. Since, in conventional practice, collars are stitched in reversed condition, with outer surfaces facing inwardly, a skilled operator must ordinarily carefully trim the excess material between the stitch line and the free edge of the assembly. This last step is necessary to ensure that when the assembly is everted or assembled to the rest of the garment, the excess does not create unsightly and unacceptable lumps, puckers or other irregularities.

Apparatus has also been proposed for simultaneously sewing and trimming of work. Examples of such apparatus appear in U.S. Pat. Nos. 1,733,220, to Farrell, issued Oct. 29, 1929; 2,286,426, to LeRoy et al., issued June 16, 1942; 1,947,495, to Routtenberg, issued Feb. 20, 1934; No. 2,730,059, to Ritter, issued Jan. 10, 1956; 2,790,405, to Graham, issued Apr. 30, 1957; 3,176,639, to Kleemann et al., issued Apr. 6, 1965; 3,176,640, to Marforio, issued Apr. 6, 1965; and 3,745,948, to Desparak et al., issued July, 17, 1973, among others. None of these patents suggests, nor do the apparatus they describe appear capable of achieving, the advantages of simultaneous sewing and trimming and the added and very significant advantages of edge-guided sewing, as suggested generally by the first-mentioned group of prior patents.

Thus, it is the principal object of this invention to provide apparatus capable of performing simultaneous sewing and trimming operations in the context of edge-guided sewing using a flat slotted work holder and guide of the general type described in such prior patents.

It is another object of this invention to provide a novel needle and cutter plate for use with sewing machines.

Other objects will appear hereinafter.

The foregoing and other objects of this invention are realized, in a presently preferred form of the apparatus, by providing a work guiding means, coupled to and projecting upwardly with respect to the bed of a sewing machine, and engageable with the guide edge of a work holder. Trimming means, such as a reciprocating trimmer blade, is juxtaposed to the work guiding means, and operates in conjunction with a cutting edge on the work guiding means to simultaneously trim the fabric as sewing progresses.

Apparatus in accordance with the present invention eliminates the need to preliminarily cut work pieces to approximate their finished shape, it being sufficient to provide the work pieces in the form of very rough "blanks," and also eliminates the need for a final hand trimming operation after sewing. Since the work pieces used in connection with the present apparatus are initially only roughly shaped, their positioning within the holder in preparation for sewing is far less critical than with prior art techniques. This, too, yields significant economies in terms of reduced operating time and elimination of the need for skilled operators.

For the purpose of illustrating the invention, there is shown in the drawings a form of the invention which is presently preferred, it being understood, however, that this invention is not limited to the precise arrangements and instrumentalities shown.

Figure 1:
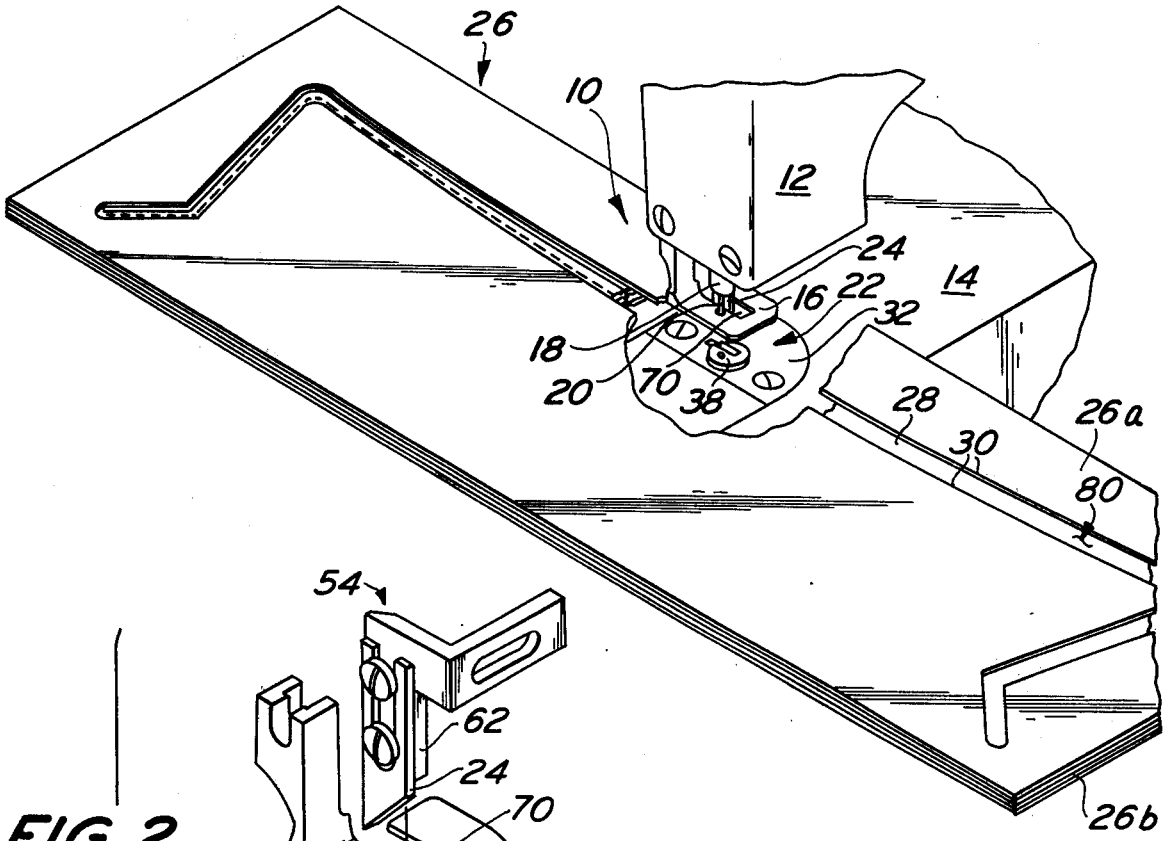
FIG. 1 is a perspective view, showing the general arrangement of work guiding and trimming apparatus in accordance with the present invention.

Referring now to the drawings in detail, wherein like numerals indicate like elements, there is seen in FIG. 1, work guiding and trimming apparatus designated generally by the reference numeral 10.

The apparatus 10 is associated with a conventional sewing machine, the head 12 and bed plate 14 of which are also seen in FIG. 1. The head 12 supports a presser foot 16, which will be described in detail below. A needle bar 18 depends from the head 12, and is driven in reciproactory linear motion with respect to the head 12 and bed plate 14 by conventional drive means, not shown. Such drive means are described in detail in the above-mentioned U.S. Pat. No. 2,790,405, and, per se, form no part of the present invention. A needle 20 is removably coupled to the needle bar 18 for movement therewith. A needle and cutter plate, designated generally by the reference numeral 22, is affixed to bed plate 14 and will also be described in detail below. A reciprocating trimmer blade 24 also depends from the head 12, and is adjacent to the needle 20 when operatively disposed.

Also depicted in FIG. 1 is a work holder, designated generally by the reference numeral 26, and having a slot 28 therein, the sides of which provide guide edges 30, the purpose of which will be explained below. The work holder 26 illustrated in the drawings is of the general type described in the above-mentioned British Pat. No. 653,177, and U.S. Pat. Nos. 3,172,379, 3,749,048, and includes upper and lower sheets **26*a* and 26*b***, respectively, hinged together at one edge. Other specific forms of work holders may be used to equal advantage.

Figure 3:
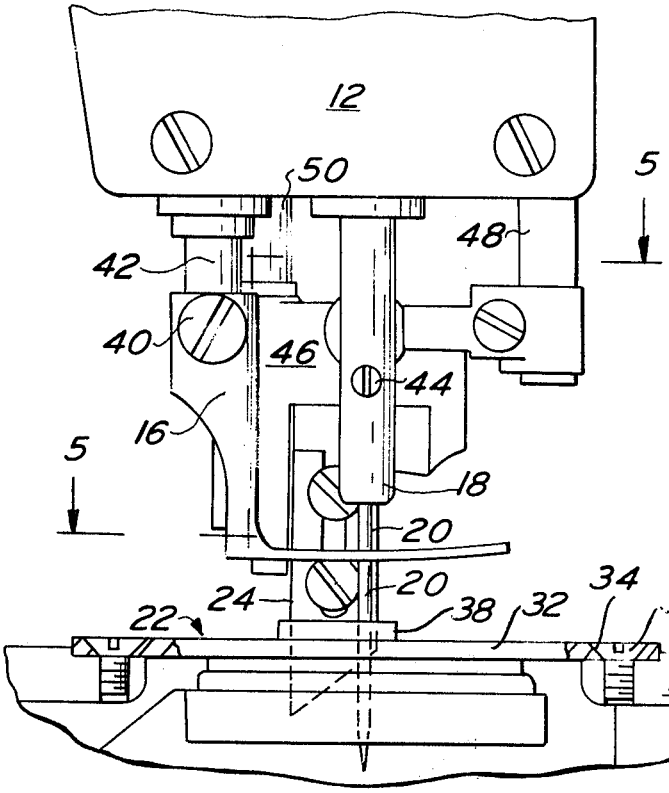
FIG. 3 is a detail view, in side elevation, showing aspects of apparatus in accordance with the present invention.
Figure 5:
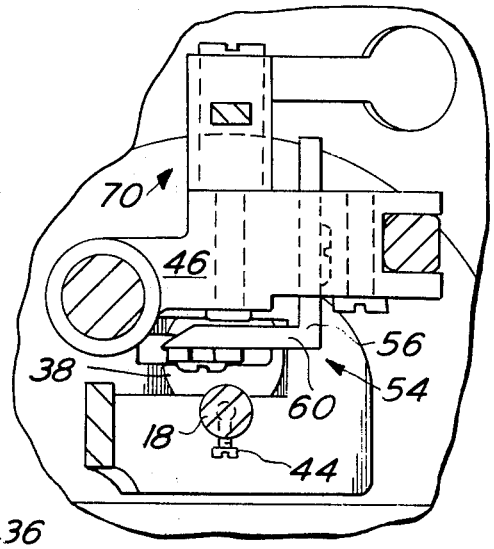
FIG. 5 is a cross-sectional view, taken along the line 5—5 in FIG. 3.
Figure 4:
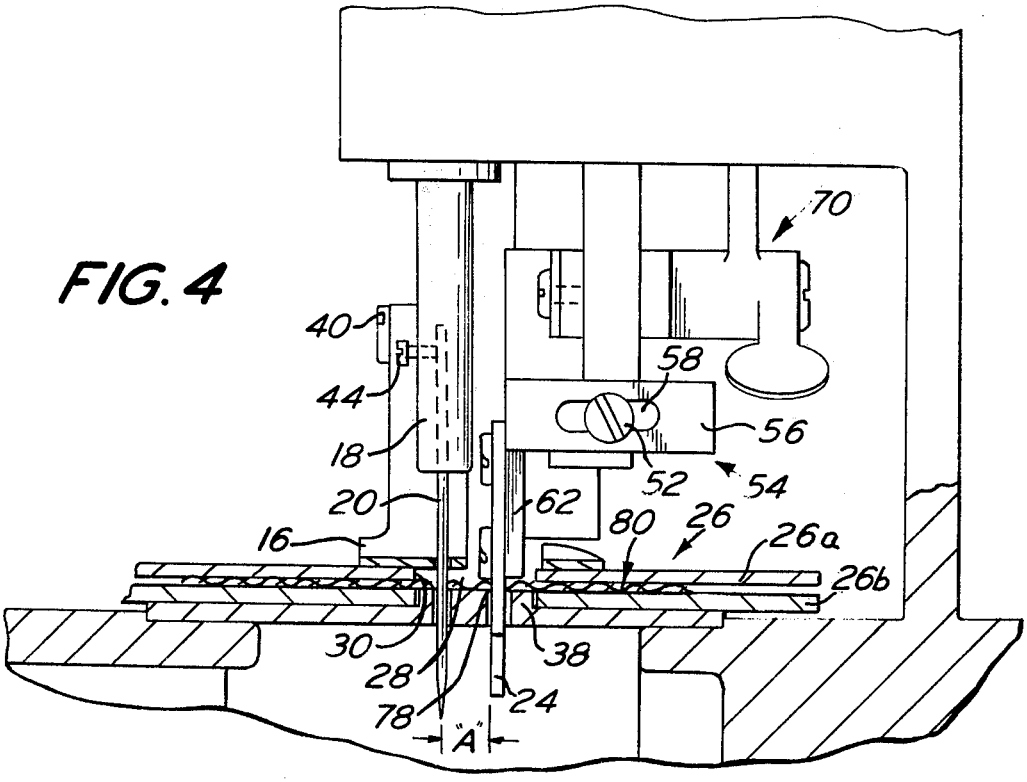
FIG. 4 is in a detail view, in front elevation, showing aspects of apparatus in accordance with the present invention.

FIGS. 3, 4 and 5 illustrate in greater detail the spatial and functional interrelationship of certain of the above-mentioned elements.

With reference to FIG. 3, the needle and cutter plate 22 is provided with a flange portion 32, having suitable spaced holes 34, adapted to receive mountings screws 36. Thus, the flange portion 32 and mounting screws 36 are a convenient means by which the needle and cutter plate 22 may be removably affixed to the bed plate 14.

The needle and cutter plate 22, in the illustrated form of the invention, also includes an upwardly projecting abutment 38, which is preferably in the form of an upstanding boss, circular in cross-section.

The presser foot 16 is affixed, by means of a suitable set screw 40 or the like, to a presser-bar 42 depending from the head 12 in a conventional manner.

The needle 20 is likewise affixed to the needle bar 18 by a set screw 44.

The trimmer blade 24 is adjustably coupled to a reciprocating slide 46, coupled to the head 12 and driven in a conventional manner, such as by means of the drive illustrated in U.S. Pat. No. 2,790,405. Pins 48 and 50 serve to constrain the slide 46 to movement in a direction generally perpendicular to the plane defined by the bed plate 14, all in a manner described in greater detail in the above-mentioned patent.

Secured to the slide 46 by a set screw 52 (seen in FIGS. 4 and 5) is an angle bracket designated generally by the reference numeral 54. The angle bracket 54 includes: a generally horizontal leg 56 having an elongated slot 58, through which the set screw 52 may extend; another horizontal leg 60 affixed to the leg 56 and extending at right angles with respect thereto; and a depending leg 62 extending downwardly from the horizontal leg 60. The trimmer blade 24 is removably and adjustably secured to the depending leg 62 by set screws 64 and 66. Selectively engageable drive means, designated generally by the reference numeral 68, and seen in FIGS. 4 and 5, and coupled to the slide 46 to transmit motion thereto.

Figure 2:
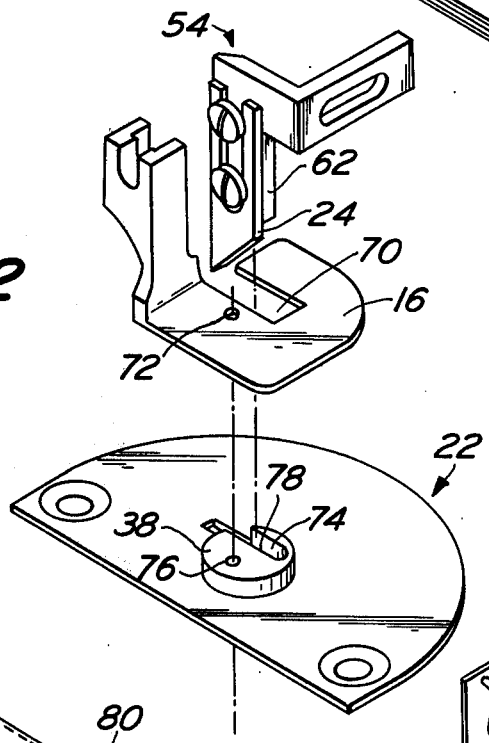
FIG. 2 is an exploded view, showing the spatial and functional relationship of certain elements of apparatus in accordance with the present invention.

Referring now to FIGS. 1 and 2, the orientation of the trimmer blade 22, presser foot 42, needle and cutter plate 22, and associated elements in their operative disposition is illustrated.

The presser foot 16, it will be seen, has a cutaway portion 70, providing a clearance slot into which the trimmer blade and depending leg 62 of the bracket 54 may project. The presser foot 16 is also provided with a clearance opening 72, through which the needle 20 may project.

The abutment 38 on the needle and cutter plate 22 has a clearance opening 74, which, in the illustrated embodiment, extends into the flange portion 32 of the needle and cutter plate 22. The abutment 38 also includes a second clearance opening, or needle hole 76, into which the needle 20 may project. One edge of the above-mentioned clearance opening 74 provides a stationary cutting edge 78 against which the trimmer blade 24 works to provide a shearing effect on a work piece overlying the clearance opening 74 and abutment 38.

Referring once again to FIG. 4, there is seen in cross-section the spatial and functional interrelationship of the elements shown in FIGS. 1 and 2 during a typical sewing and trimming operation. The work holder 26, seen in cross-section, rests upon the needle and cutter plate 22, with the abutment 38 extending upwardly into the slot 28 in the lower sheet **26*b*. The height of the abutment 38 is preferably such that the plane of its upper surface lies approximately in the plane of the upper surface of the lower sheet 26*b*. In operation, the work, designated generally by the reference numeral 80 and comprising a suitable number of plies of fabric, interfacings and the like, is disposed between the sheets 26*a* and 26*b*, and bridges the slot 28. The work also overlies the upper face of the abutment 38. The presser foot 16 contacts and rides upon the upper surface of the sheet 26*a* and maintains the work holder 26 in sliding engagement with the flange portion 32 of the cutter plate 22. The abutment 38 is thus maintained within the confines of the slot 28, and contact between the abutment 38 and guide edges 30 defined by the sides of the slot 28 determines the path of the needle 20 with respect to the work 80. Such contact also determines, of course, the path described by the trimmer blade 24 with respect to work 80**, so that trimming occurs adjacent to the zone of stitch formation along the length and contour of the sewed seam.

The spacing of the trimmer blade 24 and needle 20 is determined by the geometry of the slide 46, bracket 54 and head 12, so that the trim line, that is, the line on which trimming of the work piece occurs, is spaced from the stitch line by a uniform distance at all points along the length of the stitch line. This distance is designated in FIG. 4 by the letter "A." The trimmer blade 24 and cutting edge 78, and the needle 20, can, as a practical matter, be sufficiently closely coupled so that the portion of the work lying between the stitch line and the trim line (the distance A) is sufficiently small to permit everting of the sewed work without any hand trimming whatsoever. In one presently operable form of the invention, the center line of the needle hole 76 is spaced from the cutting edge 78 (and hence the trim line spaced from the stitch line) by just three-eighths of an inch. Other desired spacings can be accomplished, of course, by the use of needle and cutter plates 22 having different dimensions, and by adjustment of the position of the trimmer blade 24 with respect to the slide 46. The close spacing of the needle 20 and cutter blade 24, and the operative association of these elements with the abutment 38, makes it possible to simultaneously sew and trim, and yet retain the advantages of edge-guided sewing.

With the above-described apparatus, sewing and trimming can be effectuated at speeds at which sewing alone is now done, using prior art apparatus and work holders such as the work holder 26.

Figure 6:
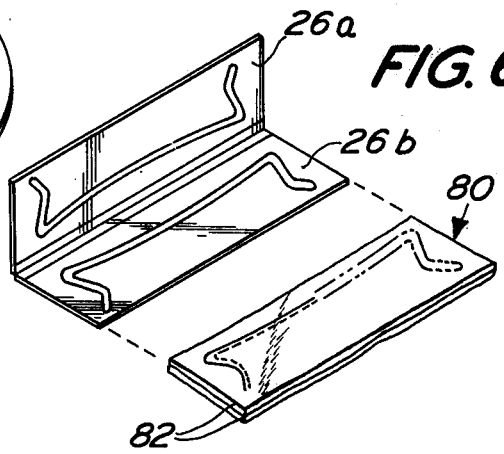
FIG. 6 is a perspective view, showing diagrammatically a work assembly and its spatial relationship with a work holder in one application of the principles of the present invention.

Additional time savings are realized because roughly cut work blanks, such as the assembled blanks 82 seen in FIG. 6, can be used. It will be seen in FIG. 6 that the blanks 82 are roughly rectangular in shape, substantially all of the remaining shaping of the blanks being accomplished by the trimming function of the above-described apparatus. The blanks 82 can be positioned in the work holder 26 rapidly, even by an inexperienced or unskilled operator, and without the degree of care in positioning which would be required if the blanks, as in conventional prior art practice, were precut to approximately their final desired outline.

Figure 7:
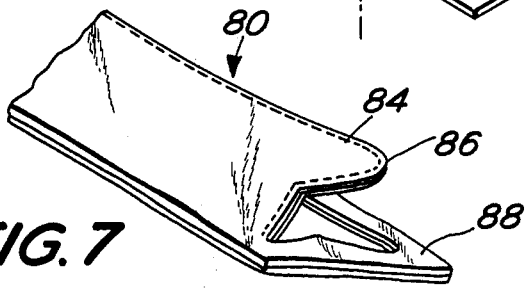
FIG. 7 is a partial perspective view of a work assembly, after sewing and trimming in accordance with the principles of the present invention.

FIG. 7 illustrates a workpiece 80' as it appears after sewing and trimming in accordance with the present invention. The stitch line is designated by the reference numeral 84, and the trim line by the reference numeral 86. It will be apparent that all that need be done to complete the collar sub-assembly is to separate the excess material 88 from the remainder of the work 80 and to evert the work 80.

The present invention may be embodied in other specific forms without departing from its spirit or essential attributes. Accordingly, reference should be made to the appended claims, rather than to the foregoing specification, as indicating the scope of the invention.

I claim:

1. For use with a work holder having a guide slot thereon, sewing and trimming apparatus comprising work guiding means affixed to and projecting upwardly with respect to the bed of a sewing machine and adapted to guidingly engage the guide slot of the holder, reciprocating trimming means operatively coupled to said sewing machine and juxtaposed to said work guiding means, a reciprocating needle operatively coupled to the sewing machine and adjacent to said trimming means, said trimming means and said needle being so positioned as to be adapted to extend into and through the guide slot of the holder when said work guiding means is guidingly engaged with the holder, and a cutting edge on said work guiding means, said trimming means cooperating with said cutting edge to trim fabric simultaneously with sewing thereof adjacent to the zone of stitch formation.

2. Apparatus in accordance with claim 1, wherein said work guiding means comprises an upwardly projecting cylindrical boss.

3. Apparatus in accordance with claim 1, wherein said work guiding means comprises an upwardly projecting cylindrical boss, said cutting edge being one edge of a clearance opening in said boss.

4. Apparatus in accordance with claim 3, and a second clearance opening in said boss adapted to receive said needle.

5. Apparatus in accordance with claim 1, and a presser foot operatively associated with the sewing machine and overlying said work guiding means when operatively disposed, to maintain the work holder in engagement with said work guiding means.

6. Apparatus in accordance with claim 5, said cutting edge comprising one edge of a first clearance opening in said work guiding means, a second clearance opening in said work guiding means adapted to receive said needle, said presser foot having a hole therethrough adapted to receive said needle and in alignment with said second clearance opening when said presser foot is operatively disposed, and a cut-out portion in said presser foot, said trimming means comprising a blade extending through said cut-out portion when said presser foot is operatively disposed.

7. Apparatus in accordance with claim 1, and a work holder comprising upper and lower sheets having congruent guide slots extending therethrough, said sheets adapted to receive and retain work therebetween, the height of said work guiding means being approximately equal to the thickness of said lower sheet, and a presser foot operatively associated with the sewing machine and overlying said work guiding means, said presser foot being adapted to engage said upper sheet to maintain said work holder in engagement with said work guiding means.

8. Apparatus in accordance with claim 7, wherein said work guiding means comprises an upwardly projecting cylindrical boss.

9. Apparatus in accordance with claim 8, wherein said cutting edge is one edge of a clearance opening in said boss.

10. Apparatus in accordance with claim 9, and a second clearance opening in said boss adapted to receive said needle.

11. For use in conjunction with a sewing machine having a reciprocating needle and reciprocating trimming means adapted to sew the work adjacent to the zone of stitch formation, and a work holder having a slot therein for engagement with guide means coupled to the sewing machine, a combined needle and cutter plate having an abutment thereon defining the guide means, said abutment comprising a boss projecting upwardly with respect to the bed of the sewing machine and adapted to extend into and guidingly engage the slot of the work holder when said plate is operatively disposed, and a clearance opening in said abutment adapted to receive said trimming means, one edge of said clearance opening being a cutting edge juxtaposed to and operatively associated with said trimming means when said plate is affixed to the bed of a sewing machine.

12. A combined needle and cutter plate in accordance with claim 11, wherein said abutment comprises a cylindrical boss.

13. A combined needle and cutter plate in accordance with claim 11 and a second clearance opening in said plate, adapted to receive said needle when said plate is operatively disposed.

14. A combined needle and cutter plate in accordance with claim 11, having a flange portion adapted to be secured to the bed of a sewing machine, said abutment being coupled to and projecting from said flange portion.

15. A combined needle and cutter plate in accordance with claim 14, wherein said clearance opening extends into said flange portion.

16. A combined needle and cutter plate in accordance with claim 15, wherein said abutment comprises a cylindrical boss, and a second clearance opening in said plate, adapted to receive said needle when said plate is operatively disposed.

* * * * *